US006461782B1

(12) United States Patent
Sasada et al.

(10) Patent No.: US 6,461,782 B1
(45) Date of Patent: Oct. 8, 2002

(54) TONER AND METHOD FOR IMAGE FORMATION

(75) Inventors: Shinya Sasada; Hideo Nakanishi; Munekazu Satake; Nobuaki Kamei; Masakazu Iwata, all of Kyoto (JP)

(73) Assignee: Sanyo Chemical Industries, Ltd., Kyoto-Fu (JP)

( * ) Notice: Subject to any disclaimer, the term of this patent is extended or adjusted under 35 U.S.C. 154(b) by 0 days.

(21) Appl. No.: 09/623,740

(22) PCT Filed: Mar. 11, 1998

(86) PCT No.: PCT/JP98/01075

§ 371 (c)(1),
(2), (4) Date: Nov. 22, 2000

(87) PCT Pub. No.: WO99/46645

PCT Pub. Date: Sep. 16, 1999

(51) Int. Cl.[7] ..... G03G 9/087

(52) U.S. Cl. ..... 430/109.2; 430/108.1; 430/109.3; 430/109.4; 430/109.5; 430/111.4; 430/124

(58) Field of Search ..... 430/124.97, 109.2, 430/109.3, 108.5, 109, 108.1, 108.8, 111.4, 109.1, 109.5, 109.4

(56) References Cited

U.S. PATENT DOCUMENTS

| | | | |
|---|---|---|---|
| 4,640,938 | 2/1987 | Römer et al. | 522/79 |
| 5,250,387 | * 10/1993 | Held et al. | 430/97 |
| 5,905,012 | * 5/1999 | De Meutter et al. | 430/124 |
| 6,296,939 | * 10/2001 | Kunze et al. | 428/413 |

FOREIGN PATENT DOCUMENTS

| | | |
|---|---|---|
| EP | 0 347 800 A2 | 12/1989 |
| EP | 0 412 712 A1 | 2/1991 |
| EP | 0 821 281 A1 | 1/1998 |
| JP | 57-144563 | 9/1982 |
| JP | 57-176059 | 10/1982 |
| JP | 63-155055 | 6/1988 |
| JP | 64-44953 | 2/1989 |
| JP | 3-41468 | 2/1991 |
| JP | 3-125158 | 5/1991 |
| JP | 4-261405 | 9/1992 |
| WO | WO 97/47398 | * 12/1997 |

* cited by examiner

*Primary Examiner*—Janis L. Dote
(74) *Attorney, Agent, or Firm*—Finnegan, Henderson, Farabow, Garrett & Dunner, LLP

(57) ABSTRACT

A toner with a glass transition point (Tg) before curing of not lower than 35° C., said toner comprising: a toner binder composed of a resin (I) selected from the group consisting of a cation-polymerizable thermoplastic resin (A) and a radical-polymerizable thermoplastic resin (B); and a colorant. The resins making up the toner binder are polymerizable ones and are cured in fixing the image on the support so that the number average molecular weight can be increased after the fixing step. That is, a toner binder with a low number average molecular weight can be used, and fixed at a low temperature and with low energy. Because of the low number average molecular weight, the toner is low in viscosity and excellent in gloss development and can produce high-quality multi-color images. Since the toner polymerizes and cures to increase in number average molecular weight while fixing, the hot offset is hardly caused, with a high fixing strength and an excellent wear resistance developed.

24 Claims, 2 Drawing Sheets

TONER AND METHOD FOR IMAGE FORMATION

TECHNICAL FIELD

The present invention relates to a method and a toner for producing images for use as in electronic photography, electrostatic recording and electrostatic printing.

BACKGROUND ART

In toner-based image production technology as electronic photography, electrostatic recording and electrostatic printing, images are formed of toner on a support like paper, followed by fixing to produce such fixed images as photocopy and photoprint. A number of fixing methods have been known and practiced. Among them are:

The hot roller fixing method in which the toner is softened with heat and pressure under a hot roller and then is allowed to cool to solidify;

The flash fixing method in which the toner is heated and melted by a flash light as from a xenon lamp, followed by cooling to solidify; and The pressure fixing method in which the toner is plastic deformed and fixed under pressure by pressure roller without heat.

The hot roller fixing method is now dominantly practiced on the strength of its advantage over the flash fixing method with regard to thermal conductivity or energy efficiency. The toner used in the hot roller fixing method is one prepared by melt-kneading such a toner binder as styrene resin and polyester together with a colorant, followed by pulverizing. The problem with this method is that the toner will melt and stick to the hot roller (hot offset) if the temperature is too high. If the temperature of the hot roller is too low, on the other hand, the toner will not soften enough and fix well. The tendency is toward to energy saving and size reduction in equipment like copying machines. Reflecting that tendency, there is a mounting call for a higher hot offsetting temperature and a lower temperature fixability.

Multi-color copying machines and multi-color printers in particular require a toner with a lower melt viscosity because a high degree of gloss and color miscibility are needed in images. A toner binder of the sharp-melting polyester type is now used.

Some ideas which it is claimed satisfy those two requirements in hot roller fixing—a low temperature fixability and a high hot offset resistance—are proposed, including (a) one using a polyester-type toner binder partially crosslinked with a multifunctional monomer (unexamined Japanese patent publication No. "Sho"57-109825), (b) one using a toner binder with a molecular weight distribution having two peaks, one of low molecular weight and the other of high molecular weight (examined Japanese patent publication No. "Sho"63-32180), and (c) one in which a releasing component as wax and polysiloxane is added to the toner (unexamined Japanese patent publication No. "Sho"60-8309 and unexamined Japanese patent publication No. "Hei"5-197202). For multi-color equipment, furthermore, a releasing agent as silicone oil has been applied on the hot roller, because the toner in itself is liable to cause hot offset trouble.

However, the toners disclosed in unexamined Japanese patent publication No. "Sho"57-109825 and examined Japanese patent publication No. "Sho"63-32180 are indeed improved in hot offset resistance, but the low temperature fixability is sacrificed, and can never be used in multi- color image production because no luster will develop. The other toners disclosed in unexamined Japanese patent publications Nos. "Sho"60-8309 and "Hei"5-197202 are improved in hot offset resistance in black and white, but are not so high in hot offset resistance that oil-less fixing is possible in multi-color image production. The other idea that silicone oil is applied to the hot roller requires additionally an oil tank and an oil applicator, making the equipment complicated and large. What is more, the oil causes the hot roller to degrade, requiring periodical maintenance. Furthermore, oil inevitably sticks to copying paper, overhead projector (OHP) film and other parts. Stuck oil can result in a problem of deteriorated color tone on the OHP film in particular.

The flash fixing method is free from hot offset trouble unlike the hot roller fixing method because the toner does not come in direct contact with the heat source. It has also an advantage over the hot roller fixing method in that the fixing rate is high. The toner used for the flash fixing is one prepared by melt-kneading and pulverizing a toner binder as low softening point polyester and epoxy resins with a colorant.

The problem with the conventional flash fixing method is its poor light-to-heat conversion efficiency, however. Because of that, a high energy lamp is required even on a low softening point toner, which is bound to a large size of equipment and a very large electricity consumption. In addition, color toners other than the black one are low in absorption of flash light energy and are difficult to sufficiently melt and fix. Because of different light absorption rates with colors, the toner can hardly be used in multi-color image production. Attempts have been made to raise the light-to-heat conversion efficiency in the flash fixing method as exemplified by an idea of adding infrared absorber (d) (unexamined Japanese patent publication No. "Sho"58-102248). But this idea proves to be not a satisfactory solution and can not be applied in multi-color image production.

The pressure fixing method has an advantage over the thermal roller fixing method and the flash fixing method in that no heat source is required. That is, the pressure fixing method can save energy and needs no warm up time. The toner used in the pressure fixing method has to be fixed by plastic deformation alone. For the purpose, a low softening point substance easy to deform at room temperature is proposed which is capsulated with a polymer with a high hardness and a high softening point.

With such a toner possible to deform without application of heat, however, the fixed image is also liable to deform at room temperature or poor in durability, heat resistance and wear resistance. No toner of that kind has been put to practical use yet. Besides, the fixed image would be insufficient in gloss and could hardly be used in multi-color image production.

In any of those fixing methods, furthermore, a toner binder with a low viscosity or a low number average molecular weight is used to facilitate the fixing process. But that brings about some problems with the fixed image, that is, insufficient fixing strength, bending resistance (quality of toner not peeling off when the support is bent) and storage stability (quality of toner staying fixed on the support for a long time). The problem is serious especially in multi-color image production where a toner binder with a still lower viscosity is used to enhance gloss.

In addition to the foregoing three fixing methods, an ultraviolet or visible ray fixing method (e) is proposed in which a photo-curing resin is used (unexamined Japanese patent publication No. "Sho"57-144563). With no heat applied, however, the fusion bond between toner particles is insufficient in this method, and no satisfactory results can be achieved with the fixed image with regard to fixing strength, bending resistance, storage stability and gloss.

DISCLOSURE OF THE INVENTION

It is an object of the present invention to provide a method of producing images by low energy fixing process without such problems as hot offset and a toner suitable for the purpose, and more particularly a method of producing images which does not require a hot roller to fix or, if so, needs no application of silicone oil, yet produces a high degree of gloss in multi-color image production and a toner suited to this fixing method.

It is another object of the present invention to provide a method of forming fixed images excellent in fixing strength, bending resistance and storage stability and a toner adapted to that.

To achieve the foregoing objects, the present invention provides a toner comprising a toner binder and a colorant, the toner binder composed of a resin (I) selected from among cation-polymerizable thermoplastic resin (A) and radical-polymerizable thermoplastic resin (B) and the preparation having a glass transition point (Tg) before curing of not lower than 35° C.

The method of producing images according to the present invention is characterized in that an unfixed image of a toner made of a toner binder and a colorant, which is formed sticking on a recording material, is fixed by a combination of softening the toner by heat and the subsequent curing.

In the present invention, the resins making up the toner binder are polymerizable ones and are cured in fixing the image on the support so that the number average molecular weight can be increased after the fixing step. That is, a toner binder with a low number average molecular weight can be used, and fixed at a low temperature and with low energy. Because of the low number average molecular weight, also, the toner is low in viscosity and excellent in gloss development and can produce high-quality multi-color images.

Since the toner according to the present invention polymerizes and cures to increase in number average molecular weight while fixing, the hot offset is hardly caused, with a high fixing strength and an excellent wear resistance developed.

BEST MODE FOR CARRYING OUT THE INVENTION

Figure 1:
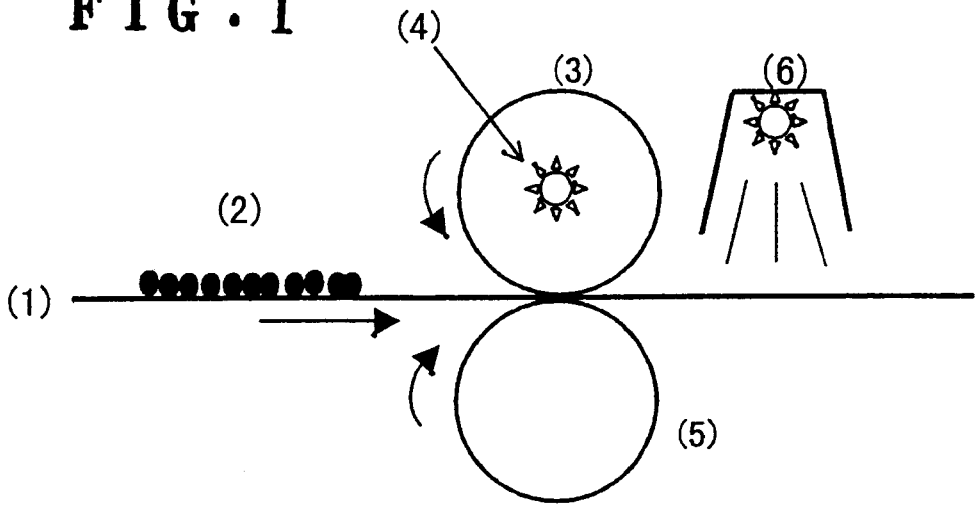
FIG. 1 is a schematic diagram showing an embodiment of the method of producing images according to the present invention.

The present invention will now be hereinafter described in detail under the following headings in that order: method of producing images in general, method of fixing images, composition of toners, properties of toners, method of manufacturing toners, composition of toner binders, method of manufacturing toner binders and typical examples of toner binders.

[Method of Producing Images in General]

The toner according to the present invention is mixed, as necessary, with carrier particles like iron powder, glass beads, nickel powder, ferrite, magnetite, and ferrite with the surface coated with resins (acrylic resin, silicone resin, etc.) and is used as developer of electrically latent images. It. is also possible to form an electrically latent image by rubbing the toner with an electrostatic charging component part like a charging blade or a charging sleeve instead of mixing carrier particles.

The toner according to the present invention is a recording material of which the electrically latent image is formed and then transferred on a support (paper, polyester film, etc.), followed by fixing the unfixed image in such equipment as a copying machine or a printer.

[Method of Fixing Images]

The suitable method of fixing unfixed images of the toner according to the present invention comprises combining the softening of toner by heat and the curing thereof.

Among the means of softening the toner by heat are contact application of heat, non-contact application of heat and self heating by reaction heat from the curing reaction. The self-heating by the curing reaction heat is not sufficient to soften the toner and desirably should be applied in combination with the contact application of heat or the non-contact application of heat.

The contact application of heat is effected by hot roller or heat film, for example. Known hot rollers can be used for the purpose. Among them is a combination of an upper metallic roller with fluororesin coated thereon and with a halogen lamp built therein as heat source and a lower roller made of silicone rubber or fluoro-rubber. The toner on the support is compressed elastically with the lower roller jointly with the upper roller. The surface temperature of the upper roller is generally 50 to 230° C., and preferably 90 to 220° C.

A heat film can replace the upper roller. As heat film, the known ones can be used such as, for example, a Teflon film which circulates between the rubber roller and a ceramic heater on the opposite side. The surface temperature of the heat film should be the same as on the aforesaid upper roller.

The non-contact application of heat uses such a heat source as infrared rays, visible rays, ultraviolet rays, hot air or micro wave. Of those, the preferable are infrared rays, because visible rays differ with different colors in heating efficiency and the softening conditions are difficult to be controled. As infrared heat source can be cited heating wire, infrared lamp, ceramic heater and carbon dioxide laser. Of them, the most desirable is the ceramic heater because it is high in heat conversion efficiency and does not emit much visible rays. With infrared rays as heat source for multi-color toners, it is noted, it is desirable that the percentage of visible rays in the irradiation should be low so as to minimize the difference with colors in heating efficiency. To be more concrete, it is desirable that the intensity ratio of radiation energy with a wavelength of 1 to 100 $\mu$m to that with a wavelength of 380 to 780 nm should be 30/70 to 100/0, and preferably 50/50 to 100/0, and more preferably 70/30 to 100/0.

Suitable as visible rays are those as used for the conventional flash fixing. They include xenon lamp and halogen lamp. Suitable as ultraviolet rays are mercury lamp (low pressure, high pressure, ultra-high pressure), hydrogen lamp, heavy hydrogen lamp, metal halide lamp and He-Cd laser.

As means of curing the toner, the following can be named: photo curing by irradiation of light, thermal curing by heating, curing by spraying or coating a hardener as initiator and a combination thereof. The photo curing by irradiation of light is the most desirable of them, because the curing time is short and a high storage stability of toner can be hoped for.

As light source for irradiation of light can be used mercury lamp (low pressure, high pressure, ultra-high pressure), hydrogen lamp, heavy hydrogen lamp, metal halide lamp, xenon lamp, carbon arc lamp, fluorescent lamp and He-Cd laser. Light rays for irradiation of light are generally 200 to 750 nm in wavelength and 1 to 600 mJ/cm$^2$ in light energy.

The softening and curing of the toner by those heat sources may be effected simultaneously or in separate steps. The process may also be repeated twice or more. An additional softening or curing step may be combined therewith.

Figure 2:
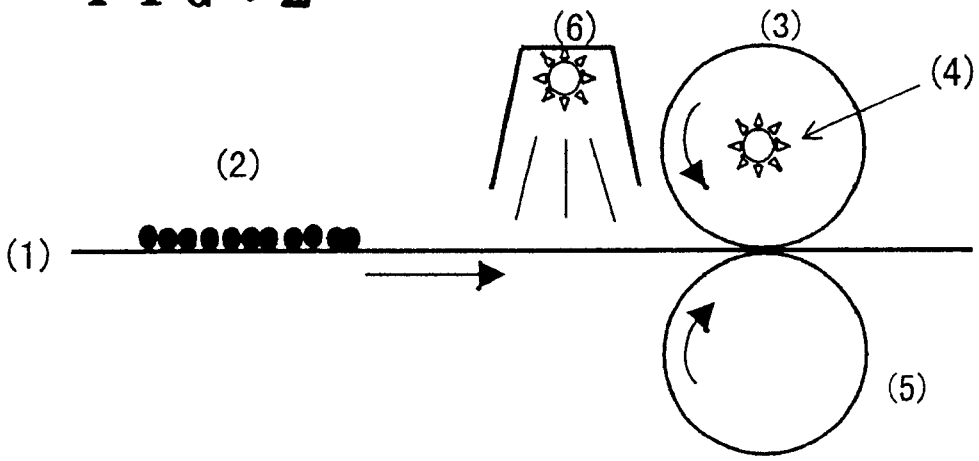
FIG. 2 is a schematic diagram showing a second embodiment of the method of producing images according to the present invention.
Figure 3:
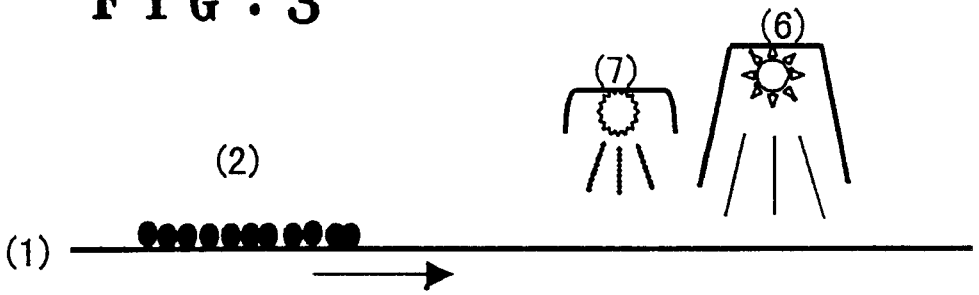
FIG. 3 is a schematic diagram showing a third embodiment of the method of producing images according to the present invention.
Figure 4:
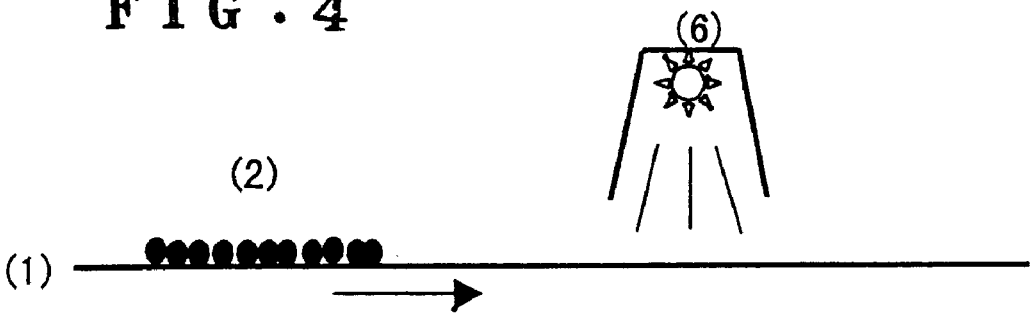
FIG. 4 is a schematic diagram showing a fourth embodiment of the method of producing images according to the present invention.
Figure 5:
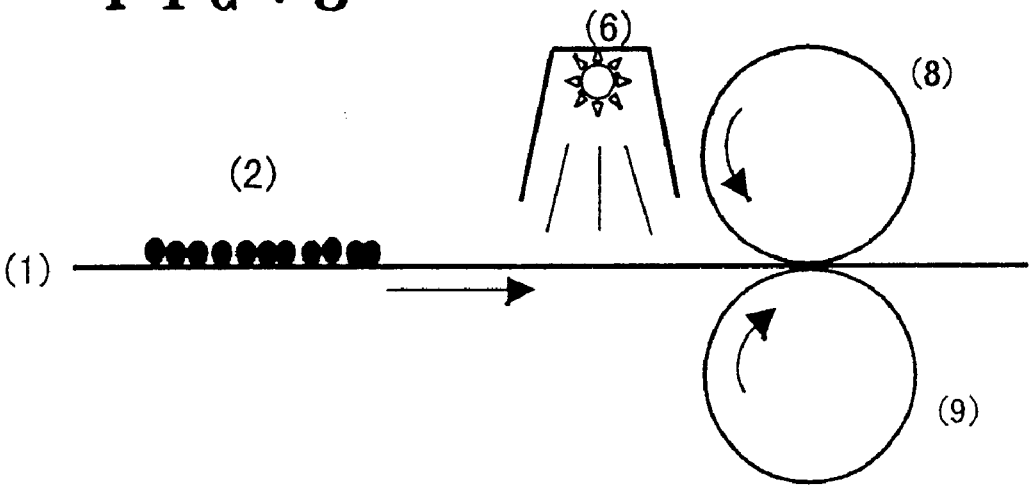
FIG. 5 is a schematic diagram showing a fifth embodiment of the method of producing images according to the present invention.

The following combinations of softening means and curing means a) to e) can be given by way of example:

a) Fixing apparatus provided with a hot roller (3) in the front stage and a light irradiator (6) in the rear stage as illustrated in FIG. 1. The toner (2) on a support (1) (usually, paper) is softened by a heater (4) in a hot roller (3) under pressure of a rubber roller (5), which is followed by irradiation of light. Thus the toner (2) is cured and fixed. This process is superior to the fixing by hot roller alone with regard to low temperature fixing effect and durability of fixed images.

b) Fixing apparatus provided with a light irradiator (6) in the front stage and a hot roller (3) in the rear stage as shown in FIG. 2. Light is irradiated to the toner (2) on a support (1) to initiate the curing of the toner (2). Then, while the curing is going on, the toner(2) is softened by heat from a heater (4) in the hot roller (3) under pressure of a rubber roller (5), to complete the curing. This way, the toner (2) is fixed. In this method, even a toner binder with a low elasticity would not cause hot offset. Thus, both low temperature fixing effect and high hot offset resistance can be attained. Especially, an excellent gloss can be obtained in multi-color image production, with the need of applying oil on the hot roller eliminated.

c) Fixing apparatus provided with an infrared irradiator (7) in the front stage and a light irradiator (6) in the rear stage as illustrated in FIG. 3. The toner (2) on a support (1) is softened by heat from the infrared irradiator (7). It is followed by irradiation of light to cure and fix the toner (2). Though heat is applied non-contact, this method is superior to the conventional flash fixing method in low temperature fixing effect, and produces fixed images excellent in durability and sharpness. The same is the case with the next method d).

d) Fixing apparatus provided with a light irradiator as shown in FIG. 4. Light is irradiated to the toner (2). on a support (1). The toner is softened and at the same time cured to fix by irradiating light.

e) Fixing apparatus provided with a light irradiator (6) in the front stage and press rollers (8), (9) in the rear stage as illustrated in FIG. 5. The toner (2) on a support (1) is softened by irradiating light. The toner is then deformed under pressure to fix. In this method, the irradiation of light raises the temperature of the toner, which then softens with the curing reaction starting at the same time. During and after deformation of the toner by press rollers, the curing proceeds and is completed. As press roller, conventional ones for pressure fixing can be used, a stainless steel roller with a linear pressure of 5 to 40 kg/cm, for example.

In curing the toner according to the present invention, a polymerization initiator is usually applied in addition to the aforesaid physical means. The initiator does not necessarily have to be mixed in the toner. Instead, the toner can be added by spraying or coating in fixing. But it is desirable to incorporate the initiator in the toner beforehand because that does not increase the complexity of equipment.

Ultraviolet rays or visible rays are applicable as light source for curing the constituent of the toner, that is, cation-polymerizable thermoplastic resin (A) or radical-polymerizable thermoplastic resin (B). The wavelength range applied in the present invention is generally 200 to 750 nm, and preferably 200 to 450 nm.

The light energy with a wavelength range of 200 to 750 nm is generally 1 to 600 mJ/cm$^2$, preferably 2 to 400 mJ/cm$^2$, and more preferably 5 to 200 mJ/cm$^2$. A light energy of less than 1 mJ/cm$^2$ can not effect the curing enough, resulting in poor durability and poor hot offset resistance. If the light energy to apply exceeds 600 mJ/cm$^2$, on the other hand, a large light source will be needed, increasing the size of equipment.

The light energy with a wavelength range of 200 to 450 nm is generally 1 to 100 mJ/cm$^2$, preferably 1 to 80 mJ/cm$^2$, and more preferably 3 to 50 mJ/cm$^2$. With a light energy of less than 1 mJ/cm$^2$, the curing will be insufficient, resulting in poor durability and poor hot offset resistance. If the light energy to apply exceeds 100 mJ/cm$^2$, on the other hand, a large light source will be required, increasing the size of equipment.

[Composition of Toners]

As polymerization initiator for curing, it is desirable to use a cationic polymerization initiator for cation-polymerizable thermoplastic resins and a radical polymerization initiator for radical-polymerizable thermoplastic resins.

Among the cationic polymerization initiators that can be named are strong acids, Lewis acids, compounds which generate cations upon light irradiation (photo-cationic polymerization initiators) and other cation-generating compounds. Of those, the desirable are photo-cationic polymerization initiators.

The strong acids include sulfuric acid, phosphoric acid, perchloric acid, trihaloacetic acids (trichloroacetic acid, trifluoroacetic acid and the like), trifluoromethane sulfonic acid and toluene sulfonic acid. Also suitable are such alkyl esters of strong acids as trifluoromethane sulfonic acid methyl ester and toluene sulfonic acid methyl ester.

The examples of Lewis acids include boron trifluoride, aluminum chloride, titanium tetrachloride and tin tetrachloride.

As the photo-cationic polymerization initiators are cited phenyl diazoium salts which are produced Lewis acids on the irradiation of light, diphenyl iodonium salts which produce Broensted acids, triphenyl sulfonium salts and triphenyl selenium salts. With the photo-cationic polymerization initiator, a senistizer can be used in combination. The suitable sensitizers include such aromatic compounds as perillene, pyrene, anthracene, coronene and phenothiazine.

Among the other cation generating compounds are triphenyl methyl chloride and iodine.

The radical polymerization initiators include thermal radical polymerization initiators which produce radicals upon heating and photo radical polymerization initiators which produce radicals on the irradiation of light. Of them, the more desirable are photo radical polymerization initiators.

As the thermal radical polymerization initiators can be named peroxide initiators, e.g., dicumyl peroxide and cumyl hydroperoxide; and azo initiators, e.g., azobis isobutylonitrile.

The suitable photo radical polymerization initiators, among others, are peroxy acid esters as 1, 3-di(t-butyl dioxycarbonyl)benzene, 3, 3', 4, 4'-tetrakis (t-butyl dioxycarboxyl)benzophenone, bisimidazole, 2-mercaptobenz-imidazole, diphenyl iodonium salt, N-phenyl glycine, 2, 4, 6-tris(trichloromethyl)-s-triazine, 3-phenyl-5-isooxazolone.

With the photo radical polymerization initiator, a sensitizer can be applied in combination. Among such sensitizes are thiopyrylium salt, merocyanine, quinoline, stilquinoline, aromatic ketones (benzophenone etc.) and ketocoumarin derivatives.

It is desirable that the polymerization initiator comprise at least one selected from the group consisting of a photo-cation polymerization initiator and a photo-radical polymerization initiator.

Furthermore, an oxygen barrier or oxygen catcher can be added when a radical polymerization initiator is used. The use thereof is desirable in that the curing process will be facilitated.

As oxygen barrier can be cited crystallizable compounds with a melting point of 40 to 150° C. among others. The melt viscosity of the crystallizable compounds is generally not higher than 1,000 cps at a temperature 20° C. higher than the melting point, preferably not higher than 500 cps, and more preferably 10 to 300 cps. The specific gravity is generally 0.7 to 1.0 at a temperature 20° C. higher than the melting point, preferably 0.75 to 0.9. The SP (solubility parameter) is generally not higher than 9.3, preferably not higher than 9.1.

As oxygen barrier can be named waxes and perfluoroalkyl compounds.

Among the waxes are polyolefin waxes, e.g., polyethylene wax and polypropylene wax; long-chain hydrocarbons, e.g., paraffine wax and sasol wax; carbonyl group-contained waxes. Of them, the desirable are polyolefin wax and carbonyl group-contained waxes.

The suitable carbonyl group-contained waxes include polyalkanic acid esters, e.g., carnauba wax, montan wax, trimethyl propane tribehenate, pentaerythritol tetrabehenate,. pentaerythritol diacetate dibehenate, glycerol tribehenate, 1,18-octadecandiol-bis-stearate etc.; polyalkanol esters, e.g., tristearyl trimellitate, distearyl maleate; polyalkanic acid amides, e.g., ethylene diamine dibehenyl amide; polyalkyl amides, e.g., tristearyl trimellitate amide; and dialkyl ketones, e.g., distearyl ketone. The preferable of them are polyalkanic acid esters.

As the perfluoroaklyl compounds, the following compounds can be named: perfluoroaklanes with C12 to C50, e.g., perfluorooctadecane; and perfoluoroalkyl alcohols with C8 to C20, e.g., perfluorodecyl ethanol and perfluorotetradecyl ethanol.

The content of the oxygen barrier is generally 0 to 40 percent by weight, preferably 3 to 30 percent by weight, and especially preferably 4 to 25 percent by weight.

The suitable oxygen catchers include compounds having an allyl ether group and/or a benzyl ether group. Among such compounds are allyl aklyl ethers, e.g., allyl lauryl ether and allyl stearyl ether; allyl benzyl ether; dibenzyl ether; benzyl alkyl ethers, e.g., benzyl lauryl ether and benzyl stearyl ether.

The oxygen catcher can also be introduced in the toner binder. One of the methods thereof is to react a compound having an allyl ether group or a benzyl ether group and a reactive group with the reactive group in the toner binder. Among the compounds having an allyl ether group or a benzyl ether group and a reactive group are allyl glycidyl ether, ethylene gycol monoallyl ether, benzyl glycidyl ether and ethylene glycol monobenzyl ether.

As colorants, it is possible to use at least one of known dyestuffs, pigments and magnetic powders. They include carbon black, sudan black SM, fast yellow G, benzidine yellow, pigment yellow, indo fast orange, irgacine red, balanito aniline red, toluidine red, carmine FB, pigment orange R, lake red 2G, rhodamine FB, rhodamine B lake, methyl violet B lake , phthalocyanine blue, pigment blue, brilliant green, phthalocyanine green, oil yellow GG, Kayaset YG, Orazol Brown B, oil pink OP, magnetite and iron black.

The content of colorants is generally 2 to 25 percent by weight, and preferably 3 to 10 percent by weight.

The toner according to the present invention can contain such additives as a releasing agent like wax and a charge controlling agent as well as the toner binder and colorants.

Known waxes can be used, including polyolefin waxes, e.g., polyethylene wax and polypropylene wax; long-chain hydrocarbons, e.g., paraffin wax, sasol wax; and carbonyl-contained waxes. Of them, the preferable are polyolefin waxes for black and white toner and carbonyl group-contained waxes for multi-color toners.

The carbonyl group-contained waxes include polyalkanic acid esters, e.g., carnauba wax, montan wax, trimethylol propane tribehenate, pentaerythritol tetrabehenate, pentaerythritol diacetate dibehenate, glycerol tribehenate, 1,18-octadecandiol-bis-stearate etc.; polyalkanol esters, e.g., tristearyl trimellitate and distearyl maleate; polyalkanic acid amides, e.g., ethylene diamine dibehenyl amide; polyalkyl amides, e.g., tristearyl trimellitate amide; and dialkyl ketones, e.g., distearyl ketone. Of those carbonyl group-contained waxes, the preferable are polyalkanic acid esters.

The wax content in the toner is generally 0 to 40 percent by weight, preferably 2 to 30 percent by weight and especially preferably 3 to 25 percent by weight.

As the charge controlling agent can be used known ones including nigrosine dyes, quaternary ammonium salt compounds, quaternary ammonium salt group-contained polymers, metal complex azo dyes, salicylic acid metal salts, sulfonic group-contained polymers, fluorine-contained polymers and halogen-substituted aromatic ring-contained polymers. The content of charge controlling agents is generally 0 to 5 percent by weight.

Fluidizing agents also can be used. The fluidizing agents suitable for the purpose include such known ones as colloidal silica, alumina powder, titanium oxide powder and calcium carbonate powder. The content of fluidizing agents is generally 0 to 2 percent by weight.

[Properties of Toners]

The glass transition point (Tg) before curing of the toner of the present invention is generally 35 to 85° C., preferably 40 to 70° C., and more preferably 45 to 65° C. If the glass transition point is less than 35° C., the toner will be poor in thermal resistance and storage stability. With the pre-curing glass transition point exceeding 85° C., the toner will deteriorate in low temperature fixability.

For better fixability and durability of fixed images, it is desirable that the toner of the present invention will rise in glass transition point while curing in the fixing step. The difference between the post-curing glass transition point (Tg') and the pre-curing glass transition point (Tg) is generally not smaller than 3° C., preferably not smaller than 5° C. and more preferably not smaller than 7° C.

The post-curing glass transition point (Tg') can be determined by measuring the glass transition point after effecting the curing to full by completing the polymerization of the cation-polymerizable group or radical-polymerizable group in the toner. A photo-curable toner, for example, is exposed to the irradiation of light well, and after the curing is completed, the glass transition is measured.

The temperature at which the viscosity of the toner is 1,000 poises at a measuring frequency of 20 Hz is generally 70 to 160° C. for multi-color toners, preferably 90 to 160° C., and more preferably 100 to 140° C. If the temperature is less than 70° C., the thermal resistance and storage stability will become poor, while if the temperature exceeds 160° C., the gloss will deteriorate. In black and white toners, the temperature at which the viscosity of the toner is 10,000 poises at a measuring frequency of 20 Hz is generally 80 to 150° C., preferably 90 to 140° C., and more preferably 90 to 130° C. If the temperature is less than 80° C., the thermal resistance and storage stability will become poor, while if the temperature exceeds 150° C., the gloss will deteriorate.

The elasticity of the toner is not especially restricted if the fixing is effected non-contact. In case the toner is to be cured following the softening step in the hot roller fixing process, the temperature at which the pre-curing storage elastic modulus is 60,000 dynes/cm$^2$ at a measuring frequency of 20 Hz is generally 130 to 230° C. for black and white toners, preferably 130 to 220° C., and more preferably 150 to 210° C. If the temperature is less than 130° C., the hot offset resistance will be poor, while if the temperature exceeds 230° C., the fixability will deteriorate. In multi-color toners, the temperature at which the storage elastic modulus is 10,000 dynes/cm$^2$ at a measuring frequency of 20 Hz is generally not lower than 120° C., preferably 120 to 180° C., and more preferably 130 to 170° C. With the temperature less than 120 ° C., the hot offset resistance will be poor.

If the toner is to be softened after the curing in the hot roller fixing process, the respective post-curing storage elastic moduli given for the foregoing hot roller fixing process are applicable for black and white toner and multi-color toners.

[Method of Manufacturing Toners]

The following ingredients are first dry-blended and then kneaded while being molten, for instance, in a kneader: toner binder, colorant and, as necessary, initiator, oxygen catcher, oxygen barrier, wax and charge controlling agent. After cooling, the mixture is crushed into coarse particles and pulverized into fine particles, for instance, by jet pulverizer. The subsequent screening by air gives a fine powder with a particle diameter of 5 to 20 $\mu$m. The powder is dry-blended with a fluidizing agent as necessary to produce a toner of the present invention.

[Composition of Toner Binders]

The cation-polymerizable thermoplastic resin (A), one of the alternative constituent toner binders of the present invention, contains a group capable of causing cationic polymerization like unsaturated groups (a1) and heterocyclic groups (a2).

As the cation-polymerizable unsaturated groups (a1) can be named functional groups having cation-polymerizable carbon-carbon double bonds such as alkenyl ether-type functional groups, e.g., vinyl ether group, propenyl ether group and isopropenyl ether group; styrene-type functional groups, e.g., styryl group, isopropenyl phenyl group, propenyl phenyl group and vinyl naphthyl group; diene-type functional groups, e.g., butadienyl group and hexadienyl-group; and alkene-type functional groups, e.g., vinyl group, propenyl group and isopropenyl group.

Of those groups, the preferable are alkenyl ether-type functional groups and styrene-type functional groups, the more preferable are vinyl ether group and propenyl ether group, and the especially preferable is propenyl ether group.

Among the cation-polymerizable heterocylic groups (a2) are 2- to 5-membered ring cyclic ethers, e.g., glycidyl group, epoxy cyclohexyl group and tetrahydrofurfuryl; 3- to 5-membered ring cyclic sulfide groups, e.g., thiirane-type functional groups; and 3- to 4-membered ring cyclic imine groups, e.g., methyleneimine-type functional groups. Of those groups, the preferable are the 2- to 5-membered ring cyclic ether groups, and the especially preferable are the glycidyl group and the epoxy cyclohexyl group.

The other of the alternative constituent toner bindersi-s a radical-polymerizable thermoplastic resin (B). Among the radical-polymerizable groups (b) contained therein are acryloyl groups, e.g., (meth)acryloyloxy groups and (meth) acryloylamide group; styrene-type functional groups, e.g., styryl group, isopropenyl phenyl group, propenyl phenyl group and vinyl naphthyl group; diene-type functional groups, e.g., butadienyl group and hexadienyl group; vinyl ester-type functional groups, e.g., vinyl ester group and isopropenyl ester group; and vinyl ketone-type functional groups, e.g., vinyl ketone group and isopropenyl ketone group.

Of those groups, the preferable are acryloyl groups, vinyl ester groups and vinyl ketone groups, the more preferable are acryloyl groups, and the especially preferable is acryloyloxy group.

The content of the cation-polymerizable groups (a) or the radical-polymerizable groups (b) in the resin in terms of the number average molecular weight per functional group is generally 200 to 40,000, preferably 500 to 20,000, and more preferably 1,000 to 8,000. If the content is less than 200 or exceeds 40,000, the fixing strength on paper of the toner after fixing will be weak, with the fixed image deteriorated in bending resistance and storage stability.

As the main component in the toner constituent binder resin (I), at least one of the following, among others, can be named: vinyl resins, polyester resins, epoxy resins and polyurethane resins. Of those resins, preferred for black and white tones are vinyl resins and polyester resins, and especially preferred are polyester resins. Preferable for multi-color toners are vinyl resin and epoxy resin, and especially preferable are polyester resins.

Among the vinyl resins are styrene acrylic resins, styrene butadiene resins and acrylic resins. Of those vinyl resins, preferred are styrene acrylic resins.

The styrene acrylic resins include copolymers between styrene and acrylic monomers, and copolymers between styrene and other monomers which can copolymerize with acrylic monomers. Among such acrylic monomers are alkyl (meth)acrylates with C1 to C18, e.g., methyl (meth) acrylates, ethyl (meth)acrylates, butyl (meth)acrylates, 2-ethyl hexyl (meth)acrylates, lauryl (meth)acrylates and stearyl (meth)acrylates; and substituted (meth)acrylates, e.g., hydroxyethyl (meth)acrylates and dimethyl aminoethyl (meth)acrylates. Among the copolymerizable other monomers are nitrile group-contained monomers, e.g., (meth) acrylonitriles; unsaturated carboxylic acids, e.g., (meth) acrylic acids, maleic anhydride and itaconic anhydride; vinyl esters, e.g., vinyl acetate and vinyl propionate; halogenated olefins, e.g., vinyl chloride and vinyl bromide; vinyl ethers, e.g., methyl vinyl ether and butyl vinyl ether; substituted styrenes, e.g., á-methyl styrene, p-methyl styrene, chlorostyrene and chloromethyl styrene.

Among the styrene butadiene resins are copolymers between styrene and butadiene and copolymers between styrene and other monomers which can copolymerize therewith. The copomerizable other monomers are the same as enumerated above for the styrene acrylic resins.

Among the acrylic resins are copolymers between methyl (meth)acrylates and copoymerizable other monomers. The copolymerizable other monomers include other acrylic monomers and other monomers than styrene and methyl (meth)acrylates. Among the other acrylic monomers and other monomers are those enumerated above for the styrene acrylic resins.

The polyester resins include polycondensates between polyols (x) and polycarboxylic acids (y).

As polyol (x) can be named diols and tri- and higher valent polyols. Diol is preferably applied alone or mixed with a small quantity of trivalent or higher valent polyol.

As diols, the following can be cited: alkylene glycols, e.g., ethylene glycol, 1,2-propylene glycol, 1,3-propylene glycol, 1,4-butandiol and 1,6-hexandiol; alkylene ether glycols, e.g., diethylene glycol, triethylene glycol, dipropylene glycol, polyethylene glycol, polypropylene glycol and polytetramethylene glycol; alicylic diols, e.g., 1,4-cyclohexane dimethanol and hydrogenated bisphenol A; bisphnols, e.g., bisphenol A, bisphenol F and bisphenol S; adducts of the aforesaid alicyclic diols with alkylene oxides, e.g., ethylene oxide, propylene oxide and butylene oxide; and adducts of the aforesaid bisphenols with alkylene oxides, e.g., ethylene oxide, propylene oxide and butylene oxide. Of those, preferred are alkylene glycols having 2 to 12 carbon atoms and adducts of bisphenols with alkylene oxides. Especially preferred are adducts of bisphenols with alkylene oxides and their combination use with alkylene glycols having 2 to 12 carbon atoms.

Among the trivalent and higher valent polyols are aliphatic polyalcohols, e.g., glycerol, trimethylolethane, trimetylolpropane, pentaerythritol and sorbitol;. trivalent and higher valent phenols, e.g., triphenol PA, phenol novolak and cresol novolak; and adducts of polyphenols with alkylene oxides.

As examples of polycarboxylic acids (y) can be cited dicarboxylic acids and trivalent and higher valent polycarboxylic acids. It is preferable to use dicarboxylic acid alone or mixed with a small quantity of trivalent or higher valent polycarboxylic acid.

As the dicarboxylic acids, the following compounds can be cited: alkylene dicarboxylic acids, e.g., succinic, adipic, sebacic and dodecenylsuccinic acids; alkenylene dicarboxylic acids, e.g., maleic and fumaric acids; aromatic dicarboxylic acids, e.g., phthalic , isophthalic, terephthalic and naphthalene dicarboxylic acids. Preferred of those compounds are alkenylene dicarboxylic acids having 4 to 20 carbon atoms and aromatic dicarboxylic acids having 8 to 20 carbon atoms.

Among the trivalent and higher valent polycarboxylic acids are aromatic polycarboxylic acids having 9 to 20 carbon atoms, e.g., trimellitic acid and pyromellitic acid.

As polycarboxylic acids (y) the above-mentioned compounds may be used in the form of acid anhydrides or lower alkyl esters of, e.g., methyl ester, ethyl ester and isopropyl ester.

Named as epoxy resins are bisphenols, e.g., bisphenol A, bisphenol F and bisphenol S, and addition condensates with 20 epichlorohydrin.

Among the polyurethane resins are polyadducts of polyols (x) and polyisocyanates (z). The examples of the polyols (x) are the same as those enumerated above as constituent of polyester resins. The preferable examples are also.the same as given there.

As to polyisocynates (z), the following compounds can be named: aliphatic polyisocyanates, e.g., tetramethylene diisocyanate, hexamethylene diisocyanate and 2,6-diisocynatomethyl caproate; alicyclic polyisocyanates, e.g., isophorone diisocyanate and cyclohexylmethane diisocyanate; aromatic diisocyanates, e.g., tolylene diisocyanate and diphenyl methane diisocynate; araliphatic diisocyanates, e.g., á, á, á', á'-tetramethyl xylylene diisocyanates; isocyanurates; those enumerated polyisocyanates blocked with phenol derivatives, oxime, caprolactam and the like; and combinations of two or more of those enumerated compounds. Of those, preferred are alicyclic polyisocyanates and aromatic diisocyanates.

In the toner of the present invention, all the polymer molecules in. the toner binder do not necessarily have to contain cation-polymerizable groups or radical-polymerizable groups. That is, it is possible to incorporate a thermoplastic resin (II) having neither cation-polymerizable groups nor radical-polymerizable groups along with the aforesaid cation-polymerizable thermoplastic resins (A) or radical-polymerizable thermoplastic resins (B). When (II) is to be incorporated, it is desirable that (II) and (A) or (B) are compatibilized into each other at least in part and that the molecular weight of (II) is larger than that of (A) or (B).

The number average molecular weight (Mn) of the toner binder of the present invention is generally 1,000 to 20,000, preferably 1,500 to 15,000, and more preferably 1,800 to 8,000. A toner with less than 1,000 in Mn is poor in thermal resistance and storage stability as well as durability. If the Mn exceeds 20,000, the low temperature fixability will fall.

The toner binder of the present invention for black and white toner to be used in the hot roller fixing process is preferably not lower than 10, and more preferably not lower than 30 in the molecular weight distribution (Mw/Mn). If a toner binder with less than 10 in Mw/Mn is used in black and white toners for the hot roller fixing process, no sufficient hot offset resistance can be obtained.

For other toners as multicolor ones, it is desirable that the Mw/Mn should be not higher than 5 in the interest of low temperature fixability and gloss in particular.

[Method of Manufacturing Toner Binders]

The resins (I)—cation-polymerizable thermoplastic resins (A) and radical-polymerizable thermoplastic resins (B) can be prepared by either of the following processes, for example: process-1 in which the constitutent monomer of the thermplastic resin, and a monomer containing a copolymerizable functional group and (a) or (b) are copolymerized when the thermoplastic resin is polymerized, or process-2 in which the thermoplastic resin containing a reactive group is reacted with a compound containing (a) or (b) and a reactive group.

Process-1 uses monomers containing function groups copolymerizable with the constitutent monomer of the thermoplastic resin and cation-polymerizable groups (a). The examples of those monomers are ones having radical-polymerizable groups and cation-polymerizable groups, e.g., (meth)acryloyloxy ethyl propenyl ethers, (meth) acryloyloxy ethyl vinyl ethers, adducts of (meth)acrylic acids with propenyl glycidyl ether, adducts of hydroxy ethyl (meth)acrylates with propenyl glycidyl ether and adducts of glycidyl (meth)acrylates with hydroxy ethyl propenyl ether; diols containing cation-polymerizable groups, e.g., 2,3-dihydroxypropyl glycidyl ether; and dicarboxylic acids having cation-polymerizable groups, e.g., ester between hydroxy ethyl propenyl ether and trimellitic acid.

The cation-polymerizable group (a) can be incorporated by either process-1 or process-2 without difficulty. But the radical-polymerizable group (b) is easier to incorporate by process-2, because in process-1, the radical-polymerizable group (b) tends to polymerize, too, when polymerizing the thermoplastic resin.

In process-2, the reactive groups of the thermoplastic resin and the reactive groups of the compounds containing (a) or (b) are combined. The combination examples are: isocyanate groups and active hydrogen groups (e.g., amino group, alcoholic hydroxyl group, phenolic hydroxyl group, mercapto group and carboxyl group); epoxy groups (e.g., glycidyl groups) and active hydrogen groups (e.g., amino group, carboxyl group, phenolic hydroxyl group, mercapto group and alcoholic hydroxyl group); and acid anhydride groups and active hydrogen groups (e.g., amino group, alcoholic hydroxyl group and mercapto group). That is, say, the cation-polymerizable group can be incorporated into the thermoplastic resin by reacting a thermoplastic resin having isocyanate groups, e.g., NCO-terminated polyester prepolymer, and a compound having an alcoholic hydroxyl group and a cation-polymerizable group, e.g., ethylene glycol monopropenyl ether. It is also possible to introduce a radical-polymerizable group into the thermoplastic resin by reacting a thermoplastic resin having alcoholic hydroxyl groups, e.g., OH-terminated polyester prepolymer, and a compound having a carboxyl group and a radical-polymerizable group ,e.g., acrylic acid.

The conditions for manufacturing the toner binder for use in the present invention will now be described hereinafter by way of example.

In producing the aforesaid toner binder comprising a vinyl resin, polymerization is effected with a radical initiator. Among the radical initiators are azo initiators, e.g., azobis isobutyronitrile and azobis valeronitrile, and peroxide initiators, e.g., benzoyl peroxide, t-butyl perbenzoate and di-t-butyl peroxide.

Polymerization can be effected by known polymerization methods such as solution polymerization, bulk polymerization and suspension polymerization. The following solvents can be used for solution polymerization: aromatic solvents, e.g., toluene and xylene; ketone solvents, e.g., acetone, methyl ethyl ketone, methyl isobutyl ketone and cyclohexanone; halogen solvents, e.g., dichloroethane; and amide solvents, e.g., dimethyl formamide. In the solution polymerization, the solvent is removed by distillation under normal pressure and reduced pressure after polymerization to obtain a toner binder of the present invention.

The polymerization temperature is generally 50 to 200° C., and preferably 70 to 170° C. depending on the molecular weight of the toner binder as well as the radical initiator used. The polymerization time is generally 1 to 24 hours, and preferably 2 to 12 hours.

A monomer containing a reactive group which can be converted into a cation-polymerizable group or radical-polymerizable group can be used in place of the cation-polymerizable group or radical-polymerizable group as in process-2. In this process, a compound having the reactive group and a cation-polymerizable group or radical-polymerizable group is reacted after polymerization. While the reaction conditions are selected on the basis of combination of reactive groups, the reaction temperature is generally 50 to 180° C., and preferably 70 to 160° C. The reaction time is generally 10 minutes to 24 hours, and preferably 1 to 8 hours. A solvent can be used in the reaction as necessary. The suitable solvents are the same as those enumerated for the solution polymerization.

To widen the molecular weight distribution of the toner binder, two or more polymers with different molecular weights may be mixed. The mixing can be done as by this method, for example: the polymers are dissolved in a proper solvent, followed by removal of the solvent.

To produce the aforesaid toner binder comprising a polyester resin, polycarboxylic acid (x) and polyol (y) are heated in the presence of such known catalysts as tetrabutoxy titanate and dibutyltin oxide at 150 to 280° C. to effect dehydration and condensation. Reduced pressure is effective in accelerating the reaction rate in the final stage of reaction.

If the toner binder comprising a polyester resin is to be prepared, process-2 is preferable. because it.can incorporate (a) or (b) with more ease. In this process, the aforesaid dehydration and polymerization should proceed the step of reacting a compound having a reactive group and a cation-polymerizable group or radical-polymerizable group. In the reaction, a solvent may be used as necessary. Among the solvents suitable for the purpose are aromatic solvents, e.g., toluene and xylene; ketones, e.g., acetone, methyl ethyl ketone and methyl isobutyl ketone; esters, e.g., ethyl acetate; amides, e.g., dimethyl formamide and dimethyl acetoamide; and ethers, e.g., tetrahydrofuran.

While reaction conditions are selected on the basis of the combination of reactive groups, the reaction temperature is generally 50 to 180° C., and preferably 70 to 160° C. The reaction time is generally 10 to 24 hours, and preferably 1 to 8 hours. A solvent may be used as necessary in the reaction. The suitable solvents are the same as enumerated above in the aforesaid preparation of vinyl resin.

[Typical Examples of Toner Binders]

(1) Styrene/butyl acrylate/(meth)acryloyl oxyethyl propenyl ether copolymer
(2) Reaction product between styrene/butyl acrylate/hydroxyl ethyl acrylate copolymer and propenyl glycidyl ether
(3) Reaction product between styrene/2-ethyl hexyl acrylate/(meth)acrylic acid copolymer and propenyl glycidyl ether
(4) Reaction product between styrene/butyl acrylate/(meth) acryloyl isocyanate copolymer and ethylene glycol monopropenyl ether
(5) Styrene/butyl acrylate/glycidyl (meth)acrylate copolymer
(6) Reaction product between bisphenol A ethylene oxide adduct/isopthalic acid polycondensate, diphenyl methane diisocyanate and ethylene glycol monopropenyl ether
(7) Reaction product between bisphenol A ethylene oxide adduct/terephthalic acid polycondensate, toluene diisocyanate and ethylene glycol monopropenyl ether
(8) Reaction product between bisphenol A ethylene oxide adduct/bisphenol A propylene oxide adduct/terephthalic acid polycondensate, isophorone diisocyanate and ethylene glycol monopropenyl ether
(9) Reaction product between bisphenol A ethylene oxide adduct/bisphenol A propylene oxide adduct/terephthalic acid polycondensate and propenyl glycidyl ether
(10) Reaction product between bisphenol A ethylene oxide adduct/terephthalic acid polycondensate and ethylene glycol bisglycidyl ether (glycidyl group terminal)
(11) Bisphenol A/epichlorohydrin addition condensate (epoxy group terminal)
(12) Reaction product between bisphenol A/epichlorohydrin addition condensate and ethylene glycol monopropenyl ether
(13) Reaction product between bisphenol A ethylene oxide adduct/diphenyl methane diisocyanate polycondensate and ethylene glycol monopropenyl ether
(14) Reaction product between styrene/butyl acrylate/hydroxy ethyl acrylate copolymer and glycidyl acrylate
(15) Reaction product between styrene/2-ethyl hexyl acrylate/(meth)acrylic acid copolymer and glycidyl acrylate
(16) Reaction product between styrene/butyl acrylate/(meth) acryloyl isocyanate copolymer and hydroxy ethyl acrylate

(17) Reaction product between bisphenol A ethylene oxide adduct/isopthalic acid polycondensate, diphenyl methane diisocyanage and hydroxy ethyl acrylate

(18) Reaction product between bisphenol A ethylene oxide adduct/terephthalic acid polycondensate, toluene diisocyanate and hydroxy ethyl acrylate

(19) Reaction product between bisphenol A ethylene oxide adduct/bisphenol A propylene oxide adduct/terephthalic acid polycondensate and acrylic acid

(20) Reaction product between bisphenol A/epichlorohydrin addition condensate (epoxy group terminal) and acrylic acid

(21) Reaction product between bisphenol A ethylene oxide adduct/diphenyl methane diisocyanate polycondensate and hydroxy ethyl acrylate

ACTUAL EMBODIMENTS

The invention will be understood more readily with reference to the following examples; however, these examples are intended to illustrate the invention and are not to be construed to limit the scope of the invention. The word part(s) hereunder represents weight part(s).

Actual Embodiment T1

[Synthesis of Toner Binder]

800 parts of styrene and 200 parts of butyl acrylate were mixed with 2.6 parts of 25% solution of 1, 1-bis(4, 4-di-t-butyl peroxy cyclohexyl)propane (PERCADOX 12 manufactured by NOF Corporation) as initiator and the mixture was subjected to suspension polymerization at 90 degrees centigrade, yielding a high molecular weight styrene-acryl copolymer (1).

698 parts of styrene, 52 parts of methacryloyl-oxyethylpropenyl ether and 6 parts of azobis isobutyronitrile (radical polymerization initiator) were dropped into 750 parts of toluene (solvent) in reflux for two hours to polymerize. To this compound mixture, 250 parts of high molecular weight styrene-acryl copolymer (1) was added and dissolved. Then the solvent was removed to yield a toner binder (B1).

Mn of the (B1) was 3400, Mw was 210,000.

[Toner Manufacture]

100 parts of the toner binder (B1), 5 parts of triallylsulfonium hexafluorophosphate mixture (photocation polymerization initiator UVI-6990, manufactured by UNION CARBIDE CORP.), 4 parts of low molecular weight polypropylene as mould release agent (VISCOL 660P manufactured by SANYO CHEMICAL INDUSTRIES, LTD.) and 8 parts of carbon black (MA100 manufactured by MITSUBISHI KASEI CORPORATION) were mixed and made into a toner as follows:

First, the ingredients were premixed with a Henschel mixer (FM10B manufactured by MITSUI MIIKE ENGINEERING CORPORATION) and then kneaded with a double axis kneading machine (PCM-30 manufactured by IKEGAI CORPORATION). The mixture was then fine ground with supersonic grinding machine (LABO JET manufactured by NIPPON PNEUMATIC MFG. CO.,LTD.) and pulvilized with airjet classifier (MDS-I manufactured by NIPPON PNEUMATIC MFG. CO.,LTD.)to yield 5-20 $\mu$m diameter toner particles. Then 0.5 parts of colloidal silica (AEROSIL R972 manufactured by NIPPON AEROSIL CO.,LTD.) was mixed to 100 parts of the toner particles in a sample mill to yield a toner ($T_1$) of this invention.

Tg of the (T1) was 57 degrees centigrade, and its viscosity reached 10,000 poise at 114 degrees centigrade, and its elasticity reached 60,000 dyne/cm$^2$ at 199 degrees centigrade.

The (T1) was placed on slide glass and heated to 120 degrees centigrade, and upon dissolution, ultraviolet light was irradiated with black light (Irradiator HLR100F-21 and lamp HL100DL manufactured by SEN ENGINEERING CO.,Ltd.) reduced to 60% for 0.1 seconds to cure toner. Its Tg' after curing was 65 degrees centigrade.

Actual Embodiment T2 and T3.

[Synthesis of Toner Binder]

690 parts of styrene, 33 parts of glycidyl methacrylate and 6 parts of azobis isobutyronitrile were dropped into 750 parts of toluene in reflux for one hour to polymerize. Then, 54 parts of hydroxyethyl acrylate, 0.12 parts of hydroquinone and as catalyst 1 part of 2,6-tri (dimethylaminomethyl) phenol (LUVEAK® DMP-30 manufactured by NACALAI TESQUE, LTD.) were added and reacted in reflux for 8 hours. To this compound mixture, 250 parts of high molecular weight styrene-acryl copolymer (1) was added and dissolved. This was then precipitated in methanol, filtered and dried to yield a toner binder (B2).

Mn of the (B2) was 3600, Mw was 190,000.

[Toner Manufacture]

100 parts of the toner binder (B2), 3 parts of 2,2-dimethoxy-2-phenylacetophenone (IRGACURE 651 manufactured by CIBA GEIGY), 3 parts of benzophenone, 4 parts of low molecular weight polypropylene (same quality as that used in Actual Embodiment T1) and 8 parts of carbon black (MA100) were mixed and made into a toner in the same way as in Actual Embodiment 1, and a toner of this invention (T2) was yielded.

Tg of the (T2) was 56 degrees centigrade, and its viscosity reached 10,000 poise at 115 degrees centigrade. Its elasticity reached 60,000 dyne/cm$^2$ at 195 degrees centigrade. Its Tg' after curing, measured as in Actual Embodiment 1, was 63 degrees centigrade.

Also, another toner was manufactured in the same way as in T2, apart from adding 3 parts of dibenzyl ether, and yielded a toner (T3) of this invention.

Tg of the (T3) was 55 degrees centigrade, its viscosity reached 10,000 poise at 115 degrees centigrade, and elasticity reached 60,000 dyne/cm$^2$ at 195 degrees centigrade. Its Tg' after curing, measured as in Actual Embodiment T1, was 64 degrees centigrade.

Comparative Example CT1

[Synthesis of Toner Binder]

712 parts of styrene, 38 parts of butyl acrylate, and 3 parts of ditertiary butyl peroxide were dropped into 375 parts of xylene at 170 degrees centigrade for 4 hours to polymerize. Then, 250 parts of high molecular weight styrene-acryl copolymer (1) was added into the compound mixture, then after dissolving and removing solvent, a comparison toner binder (CB1) was yielded.

The Mn of the (CB1) was 3300, and Mw was 200,000.

[Toner Manufacture]

The (CB1) was made into a toner in the same way as in Actual Embodiment 1, and a toner (CT1) yielded.

Tg of the (CT1) was 58 degrees centigrade, its viscosity reached 10,000 poise at 115 degrees centigrade, and its elasticity reached 60,000 dyne/cm$^2$ at 198 degrees centigrade. Its Tg' after curing, measured in the same manner as in Actual Embodiment T1, was 58 degrees centigrade.

Actual Embodiment T4

[Synthesis of Toner Binder]

900 parts of styrene, 100 parts of methacryloyl-oxyethyl 10 propenyl ether, and 3 parts of azobis isobutyronitrile were dropped into 800 parts of toluene reflux for one hour to polymerize, then solvent was removed and a toner binder (B3) was yielded.

Mn of the (B3) was 3,900, and Mw was 12,000.

[Toner Manufacture]

100 parts of the toner binder (B3), 5 parts of photocation polymerization initiator (same quality as that used in Actual Embodiment T1), 4 parts of pentaerythritol diacetate dibehenate and 4 parts of copper phthalocyanine pigment (Cyanine blue KRO manufactured by SANYO COLOR WORKS, LTD.) were mixed and made into a toner in the same manner as in Actual Embodiment T1 to yield a toner of this invention (T4).

Tg of the (T4) was 56 degrees centigrade, its viscosity reached 1,000 poise at 134 degrees centigrade. Its Tg' after curing, measured in the same manner as in Actual Embodiment T1, was 67 degrees centigrade. The toner after curing reached 10,000 dyne/cm$^2$ elasticity at 157 degrees centigrade.

Actual Embodiment T5

[Synthesis of Toner Binder]

900 parts of styrene, 55 parts of glycidyl methacrylate, and 3 parts of azobis isobutyronitrile were dropped into 800 parts of toluene in reflux for one hour to polymerize. Then, 90 parts of hydroxyethyl acrylate, 0.2 parts of hydroquinone and 1 part of catalyst (same quality as that used in Actual Embodiment T2) were added and reacted in reflux for eight hours, then precipitated in methanol, filtered and dried, and a toner binder (B4) was yielded.

Mn of the (B4) was 4,000, Mw was 11,000.

[Toner Manufacture]

100 parts of the toner binder (B4), 3 parts of 2,2-dimetoxy-2-phenylacetophenone (same quality as that used in Actual Embodiment T2), 3 parts of benzophenone, 10 parts of pentaerythritol diacetate dibehenate and 4 parts of copper phthalocyanine pigment were mixed, and made into a toner in the same manner as in Actual Embodiment T1 to yield a toner of this invention (T5).

Tg of the (T5) was 53 degrees centigrade and its viscosity reached 1,000 poise at 133 degrees centigrade. Its Tg' after curing, measured in the same manner as in Actual Embodiment T1, was 63 degrees centigrade. The toner after curing reached 10,000 dyne/cm$^2$ elasticity at 148 degrees centigrade.

Comparative Example CT2

[Synthesis of Toner Binder]

930 parts of styrene, 70 parts of butyl acrylate, and 3 parts of azobis isobutyronitrile were dropped into 800 parts of toluene in reflux for one hour to polymerize. Then the solvent was removed to yield a comparative toner binder (CB2).

Mn of the (CB2) was 4,200, Mw was 11,000.

[Toner Manufacture]

A toner was manufactured in the same way as in Actual mbodiment T4, and a comparative toner (CT2) was yielded.

Tg of the (CT2) was 55 degrees centigrade and its viscosity reached 1,000 poise at 133 degrees centigrade. Its Tg' after curing, measured as in Actual Embodiment T1, was 55 degrees centigrade. The toner after curing reached 10,000 dyne/cm$^2$ elasticity at i33 degrees centigrade.

Actual Embodiment T6

[Synthesis of Toner Binder]

724 parts of adduct of bisphenol-A with ethylene oxide 2 mol, 276 parts of isophthalic acid and 2 parts of dibutyltin oxide were mixed and reacted for eight hours at 230 degrees centigrade at atmospheric pressure, then further reacted for five hours at pressure reduced to 10–15 mmHg. The compound mixture was then cooled to 100 degrees centigrade , and further reacted in xylene with 232 parts of isophorone di-isocyanate for two hours. Next, 107 parts of ethylene glycol monopropenyl ether was added, and the mixture reacted for further 3 hours at 90 degrees centigrade. The resulting. compound mixture was precipitated in methanol, filtered and dried, and a toner binder (B5) was yielded.

Mn of the (B5) was 3,800, Mw was 12,000.

[Toner Manufacture]

Taking the toner binder (B5), a toner was manufactured in the same manner as in Actual Embodiment T4, except for substituting 4 parts of glycerol tribehenate for the wax to yield a toner of this invention (T6).

Tg of the (T6) was 58 degrees centigrade and its viscosity reached 1000 poise at 129 degrees centigrade. Its Tg' after curing, measured in the same manner as in Actual Embodiment T1, was 70 degrees centigrade. The toner after curing reached 10,000 dyne/cm$^2$ elasticity at 149 degrees centigrade.

Actual Embodiment T7

[Synthesis of Toner Binder]

Following the same synthesis procedure as in Actual Embodiment B5, except for substituting 122 parts of hydroxyethyl acrylate for 107 parts of ethylene glycol monopropenyl ether and adding 0.42 parts of hydroquinone during reaction, a toner binder (B6) was yielded.

Mn of the (B6) was 3,900, and Mw was 11,000.

[Toner Manufacture]

Taking the toner binder (B6), the same procedure as in Actual Embodiment T5 was followed except for substituting 10 parts of glycerol tribehenate for the wax, a toner of this invention (T7) was yielded.

Tg of the (T7) was 59 degrees centigrade, and its viscosity reached 1,000 poise at 128 degrees centigrade. Its Tg' after curing, measured in the same manner as in Actual Embodiment T1, was 69 degrees centigrade. The toner after curing reached 10,000 dyne/cm$^2$ elasticity at 138 degrees centigrade.

Comparative Example CT3

[Toner Binder Synthesis]

A comparative toner binder (CB3) was synthesized in the same manner as in Actual Embodiment B5, except for substituting 78 parts of butanol for 107 parts of ethylene glycol monopropenyl ether.

Mn of the (CB3) was 3,800, Mw was 13,000.

[Toner Manufacture]

Taking the comparative toner binder (CB3), a toner was 10 manufactured in the same manner as in Actual Embodiment T6 to yield a comparative toner (CT3).

Tg of the (CT3) was 57 degrees centigrade, and its viscosity reached 1,000 poise at 128 degrees centigrade. Its Tg' after curing, measured in the same manner as in Actual Embodiment T1, was 57 degrees centigrade Actual Embodiment T8

[Synthesis of Toner Binder]

478 parts of adduct of bisphenol-A with ethylene oxide and 146 parts of isophthalic acid were polycondensed for 5 hours at 230 degrees centigrade with 1.2 parts of dibutyltin oxide as catalyst, then for two more hours at reduced pressure. After the compound mixture was cooled to 100 degrees, it was dissolved in xylene, and 267 parts of isophorone di-isocyanate added and reacted at 100 degrees centigrade for two hours. Then, 123 parts of ethylene glycol monopropenyl ether was added and the mixture reacted for 3 hours at 90 degrees. The polymerized mixture was precipitated in methanol, filtered and dried to yield a toner binder (B7).

Mn of the (B7) was 2,400, Mw was 5,500.

[Toner Manufacture]

Taking the toner binder (B7), a toner was manufactured in the same manner as in Actual Embodiment T4, except for using no wax, and a toner of this invention (T8) was yielded.

Tg of the (T8) was 55 degrees centigrade, its viscosity reached 1,000 poise at 119 degrees centigrade. Its Tg' after curing, measured in the same manner as in Actual Embodiment T1, was 68 degrees centigrade.

Actual Embodiment T9

[Synthesis of Toner Binder]

Following the same synthesis procedure as in Actual Embodiment B7, except for substituting 140 parts of 15 hydroxyethyl acrylate for 123 parts of ethylene glycol monopropenyl ether and adding 0.42 parts of hydroquinone at polymerization, and a toner binder (B8) was yielded.

Mn of the (B8) was 2,300, Mw was 5,700.

[Toner Manufacture]

Taking the toner binder (B8), a toner was manufactured in the same manner as in Actual Embodiment T7 and a toner of this invention (T9) was yielded.

Tg of the (T9) was 56 degrees centigrade , and its viscosity reached 1,000 poise at 12.1 degrees centigrade. Its Tg' after curing, measured in the same manner as in Actual Embodiment T1, was 68 degrees centigrade.

Comparative Example CT4

[Synthesis of Toner Binder]

Following the same synthesis procedure as in Actual Embodiment B7, except for substituting 90 parts of butanol for 123 parts of ethylene glycol monopropenyl ether and a comparative toner binder (CB4) was yielded.

Mn of the (CB4) was 2,500, Mw was 5,400.

[Toner Manufacture]

Taking the comparative toner binder (CB4), a toner was manufactured in the same manner as in Actual Embodiment T8 to yield a comparative toner (CT4).

Tg of the (CT4) was 56 degrees centigrade and its viscosity reached 1,000 poise at 120 degrees centigrade temperature. Its Tg' after curing, measured in the same manner as in Actual Embodiment T1, was 56 degrees centigrade.

Actual Embodiment Al-A3 and Comparative Example CA1

The fixing mechanism of a commercially available photocopier (SF-8400A manufactured by Sharp Corporation) was modified as follows: A black light (Irradiator HLR1O0F-21 and lamp HL100DL manufactured by SEN ENGINEERING LTD.) was mounted downstream along the paper flow directed by the hot roller, and its irradiation output reduced to 60%. The hot roller paper feed speed was reduced to 120mm/sec, and its surface temperature set at 150 degrees centigrade. This is called fixing apparatus (1).

Images of a set blacked-out area were each developed using each of the toners (T1) to (T3) and the comparative toner (CT1), then fixed with the above fixing apparatus (1). Evaluations of the resulting photocopies are shown in Table 1.

Comparative Example CA2 and CA3

A photocopier was modified in the same manner as in Actual Embodiment A1, except for leaving out the black light. This is called fixing apparatus (C1).

Images each developed using each of the above toners (T1) and (T2), were fixed with the above fixing apparatus (C1).

Evaluations of the resulting photocopies are shown in Table 1.

TABLE 1

| Toner No. | Apparatus No. | Fixing strength (%) | Resistance to bending |
|---|---|---|---|
| T1 | 1 | 96 | ○ |
| T2 | 1 | 85 | Δ |
| T3 | 1 | 93 | ○ |
| CT1 | 1 | 76 | X |
| T1 | C1 | 73 | X |
| T1 | C1 | 74 | X |

[Method of Evaluation]

1. Fixing Strength

The photocopies of the blacked-out image was subjected to frequency-learning type fastness tester with five reciprocal rubbing movements (rubbing material: paper); the ratio of image intensity (%) in comparison of before and after friction, was defined as fixing strength.

2. Resistance to Bending

The photocopies of the blacked-out image were bent with the photocopied image on the inside, and the fold rubbed over with five reciprocal movements under 30 g of load. Then the paper sheets were opened, to sight check for the presence or absence of white scars remaining on the blacked-out image after bending and rubbing.

Evaluation standard: ○=no white scar

Δ=faint white scar

X=white scar present

Actual Embodiment A4–A7 and Comparative Example CA4, CA5

The fixing mechanism of a commercially available photocopier (CLC-1 manufactured by CANON INC.) was modified as follows: A black light (same as above) was mounted upstream along the paper flow directed by the hot roller, and its irradiation output reduced to 60%. The hot roller oil applicator was removed and any remaining silicon oil on the hot roller removed with toluene. Further, surface temperature of the hot roller was made variable. This was called fixing apparatus (2).

Images each developed using each of the above toners (T4) through to (T7), and comparative toners (CT2) and (CT3), were fixed with the above fixing apparatus (2).

Evaluations of the resulting photocopies are shown in Table 2.

Comparative Examples CA6 and CA7

A photocopier was modified in the same manner as in Actual Embodiment A4, except for leaving out the black light, to produce comparative fixing apparatus (C2).

Images each developed using each of the toners (T4) and (T5) were fixed with the above fixing apparatus (C2).

Evaluations of the resulting photocopies are shown in Table 2.

TABLE 2

| Toner No. | Apparatus No. | Fixing strength (%) | GLOSS (° C.) | HOT (° C.) |
|---|---|---|---|---|
| T4 | 2 | 96 | 150 | 230 |
| T5 | 2 | 90 | 150 | 210 |
| T6 | 2 | 98 | 140 | 220 |
| T7 | 2 | 92 | 140 | 200 |
| CT2 | 2 | 77 | 160 | 170 |
| CT3 | 2 | 85 | 150 | 160 |
| T4 | C2 | 75 | 160 | 170 |
| T5 | C2 | 76 | 160 | 170 |

[Method of Evaluation]

1. Fixing Strength

The photocopies of the blacked-out images fixed at 160 degrees centigrade were subjected to frequency-learning type fastness tester with five reciprocal rubbing movements (rubbing material: paper); the ratio of image intensity (%) in comparison of before and after friction, was defined as fixing strength.

2. Gloss Manifestation Temperature (GLOSS)

Images were each fixed at different hot roller temperatures to obtain photocopies, and the hot roller temperature yielding 10% of 60-degree gloss luminosity in the photocopy was called GLOSS manifestation temperature.

3. Hot Offset Temperature (HOT)

Images were each fixed at different hot roller temperatures to obtain photocopies, and the presence or absence of "hot offsetting" in the photocopy was sight observed. The hot roller temperature which generated hot offsetting was called the HOT offset temperature.

Actual Embodiments A8, A9 and Comparative Example CA8

The fixing mechanism of a commercially available pressure fixing type photocopier was modified as follows. A black light (same as above) was mounted upstream along the paper flow directed by the pressure roller. The paper feed speed was set at 120mm/sec. This was called fixing apparatus (3).

Images each developed using each of the toners (T4), (T5) and the comparison toner (CT2), were fixed with the fixing apparatus (3).

Evaluations of the resulting photocopies are shown in Table 3.

TABLE 3

| Toner No. | Apparatus No. | Fixing strength (%) | Resistance to bending |
|---|---|---|---|
| T4 | 3 | 79 | ○ |
| T5 | 3 | 72 | Δ |
| CT2 | 3 | 38 | X |

[Method of Evaluation]

1. Fixing Strength

The photocopies of the blacked-out image was subjected to frequency-learning type fastness tester with five reciprocal rubbing movements (rubbing material: paper); the ratio of image intensity (%) in comparison of before and after friction, was defined as fixing strength.

2. Resistance to Bending

The photocopies of the blacked-out image were bent with the photocopied image on the inside, and the fold rubbed over with five reciprocal movements under 30 g of load. Then the paper sheets were opened, to sight check for the presence or absence of white scars remaining on the blacked-out image after bending and rubbing.

Evaluation standard: ○=no white scar

Δ=faint white scar

X=white scar present

Actual Embodiment A10 and Comparative Example CA9

Above a belt conveyer driven at 120 mm/sec rotation speed, An 800 W halogen lamp with reflector was attached upstream along the paper flow direction, and a black light (same as above) was attached downstream along the paper flow direction with its strength reduced to 60%. This is called fixing apparatus (4).

Images each developed using each of toner (T6) and comparative toner (CT3) were fixed with the above fixing apparatus (4).

Evaluations of the fixed images are shown in Table 4.

Actual Embodiments A11 to A14 and Comparative Examples CA10 and CA11

Above a belt conveyer driven at 120 mm/sec rotation speed, a far-infrared ceramic heater (LCR-332C manufactured by KYOCERA CORPORATION) with reflector was attached upstream of the paper flow direction and powered at 80v. Also a black light (same as above) was attached downstream of the paper flow direction with its strength reduced to 60%. This is called fixing apparatus (5).

Images each developed using each of above toners (T4), (T5), (T8) and (T9), and the comparative toners (CT2) and (CT4) were fixed with the above fixing apparatus (5).

Evaluations of the fixed images are shown in Table 4.

TABLE 4

| Toner No. | Apparatus No. | Fixing strength (%) | Resistance to bending | GLOSS (%) |
|---|---|---|---|---|
| T6 | 4 | 92 | ○ | 19 |
| CT3 | 4 | 77 | X | 18 |
| T4 | 5 | 95 | ○ | 27 |
| T5 | 5 | 91 | ○ | 26 |
| T8 | 5 | 98 | ○ | 35 |
| T9 | 5 | 96 | ○ | 32 |
| CT2 | 5 | 82 | X | 25 |
| CT4 | 5 | 84 | X | 33 |

[Method of Evaluation]

1. Fixing Strength

The photocopies of the blacked-out image was subjected to frequency-learning type fastness tester with five reciprocal rubbing movements (rubbing material: paper); the ratio of image intensity (%) in comparison of before and after friction, was defined as fixing strength.

2. Resistance to bending

The photocopies of the blacked-out image were bent with the photocopied image on the inside, and the fold rubbed over with five reciprocal movements under 30 g of load. Then the paper sheets were opened, to sight check for the presence or absence of white scars remaining on the blacked-out image after bending and rubbing.

Evaluation standard: ○=no white scar

Δ=faint white scar

X=white scar present

3. Gloss

Gloss was defined as 60-degree gloss measurement of the fixed image.

INDUSTRIAL APPLICABILITY

The toner and method for producing images according to the present invention has the following advantages:

1. Fixable at low temperature and free from hot offset difficulty.
2. Eliminates the need to apply oil in multi-color development, hence size reduction of equipment. Free from oil staining paper or OHP film, and thus producing fine color-tone images.
3. Excellent gloss in multi-color image development.
4. High fixing strength and bending resistance as well as storage stability of images.
5. Enhances sharpness of images and dissolving power.

What is claimed is:

1. A toner, which comprises a toner binder and a colorant, said toner having a glass transition point (Tg) before curing of not lower than 35° C., said binder being composed of a resin (I) including a cation-polymerizable thermoplastic resin (A) having a propenyl ether group.

2. The toner of claim 1, which provides a glass transition point (Tg') after curing such that the difference (Tg'−Tg) between the glass transition point (Tg') after curing and the glass transition point (Tg) of said toner before curing is not smaller than 3° C.

3. The toner of claim 1, wherein said resin (I) comprises at least one resin selected from the group consisting of vinyl resins, polyester resins, epoxy resins and polyurethane resins.

4. The toner of claim 1, wherein said resin (I) contains the propenyl ether group in a quantity of a number average molecular weight per the propenyl ether group of 200 to 40,000.

5. The toner of claim 1, wherein said toner binder has a number average molecular weight (Mn) of 1,000 to 20,000 and a molecular weight distribution (Mw/Mn) of not higher than 5.

6. The toner of claim 1, wherein said toner binder has a number average molecular weight (Mn) of 1,000 to 20,000 and a molecular weight distribution (Mw/Mn) of not lower than 10.

7. A method of producing a fixed image, which comprises:

forming an unfixed image with a toner according to claim 1 deposited on a substrate, and fixing the unfixed image on the substrate by heat softening of the toner in combination with curing of the toner.

8. The method of claim 7, wherein said softening is effected through application of contact heating, or through application of at least one non-contact heating method selected from the group consisting of infrared heating, visible ray heating, ultraviolet heating, hot-air heating and microwave heating.

9. The method of claim 7, wherein said curing is effected through application of photo-irradiation.

10. A toner, which comprises a toner binder and a colorant, said toner having a glass transition point (Tg) before curing of not lower than 35° C.;

said binder being composed of a resin (I) selected from the group consisting of a cation-polymerizable thermoplastic resin (A) and a radical-polymerizable thermoplastic resin (B);

said resin (I) containing a polyester resin;

wherein said thermoplastic resin (A) is a thermoplastic resin (A') having a cation-polymerizable group (a) which is a cation-polymerizable unsaturated group (a1) and/or cation-polymerizable heterocyclic group (a2); and said thermoplastic resin (B) is a thermoplastic resin having a radical-polymerizable group (b) selected from the group consisting of acryloyl groups, styrene functional groups, diene functional groups, vinyl ester groups, isopropenyl ester groups and vinyl ketone functional groups.

11. The toner of claim 10, wherein said cation-polymerizable unsaturated group (a1) is either a vinyl ether group or a propenyl ether group.

12. The toner of claim 10, wherein said cation-polymerizable heterocyclic group (a2) is either a 2- to 5-membered cyclic ether group, a 3- to 5-membered cyclic sulfide group or a 3- or 4-membered cyclic imine group.

13. The toner of claim 10, wherein said thermoplastic resin (B) is a thermoplastic resin (B') having a radical-polymerizable group (b) selected from the group consisting of acryloyl groups, vinyl ester groups and vinyl ketone groups.

14. The toner of claim 10, wherein said resin (I) contains the cation-polymerizable group (a), or the radical-polymerizable group (b), in a quantity of a number average molecular weight per the functional group (a) or (b) of 200 to 40,000.

15. The toner of claim 10, further comprising an initiator selected from the group consisting of a cation polymerization initiator and a radical polymerization initiator.

16. The toner of claim 15, wherein said initiator comprises at least one selected from the group consisting of a photo-cation polymerization initiator and a photo-radical polymerization initiator.

17. The toner of claim 10, wherein said colorant comprises at least one selected from the group consisting of cyan, magenta and yellow dyes and pigments.

18. A method of producing a fixed image, which comprises:

forming an unfixed image of a toner according to claim 10 deposited on a substrate, and fixing the unfixed image on the substrate by heat softening of the toner in combination with curing of the toner.

19. A toner, which comprises a toner binder and a colorant, said toner having a glass transition point (Tg) before curing of not lower than 35° C.;

said binder being composed of a resin (I) selected from the group consisting of a cation-polymerizable thermoplastic resin (A) and a radical-polymerizable thermoplastic resin (B);

said toner further comprising an oxygen scavenger and/or a crystalline compound;

said crystalline compound having a melting point of 40° C. to 150° C., a melt viscosity of not higher than 1,000 cps at a temperature higher by 20° C. than the melting point, a specific gravity of 0.7 to 1.0 at a temperature higher by 20° C. than the melting point, and a solubility parameter of at most 9.3.

20. The toner of claim 19, wherein said oxygen scavenger is a compound having an allyl ether group and/or a benzyl ether group.

21. A method of producing a fixed image, which comprises:

forming an unfixed image with a toner according to claim 19 deposited on a substrate, and fixing the unfixed image on the substrate by heat softening of the toner in combination with curing of the toner.

22. A toner, which comprises a toner binder and a colorant, said toner having a glass transition point (Tg) before curing of not lower than 35° C.;

said binder being composed of a resin (I) selected from the group consisting of:

a cation-polymerizable thermoplastic resin (A) having a cation-polymerizable unsaturated group (a1), and a radical-polymerizable thermoplastic resin (B) having a radical-polymerizable group (b) selected from the group consisting of acryloyl groups, styrene functional groups, diene functional groups, vinyl ester groups, isopropenyl ester groups and vinyl ketone functional groups;

said resin (I) comprising at least one resin selected from the group consisting of vinyl resins, polyester resins and epoxy resins.

23. The toner of claim 22, wherein said resin (I) contains the cation-polymerizable unsaturated group (a1) or the radical-polymerizable group (b) in a quantity of a number average molecular weight per the functional group (al) or (b) of 200 to 40,000.

24. A method of producing a fixed image, which comprises:

forming an unfixed image with a toner according to claim 22 deposited on a substrate, and fixing the unfixed image on the substrate by heat softening of the toner in combination with curing of the toner.

* * * * *